US005363626A

United States Patent [19]

Hanninen

[11] Patent Number: 5,363,626

[45] Date of Patent: Nov. 15, 1994

[54] RIB FOR COVERED SHELTER FRAME

[76] Inventor: Arvi K. Hanninen, Box 33011, Regina, Saskatchewan, Canada, S4T 7X2

[21] Appl. No.: 87,528

[22] Filed: Jul. 8, 1993

[51] Int. Cl.[5] ..... E04B 1/32

[52] U.S. Cl. ..... 52/639; 52/645; 135/122

[58] Field of Search ..... 52/639, 645, 653.1, 52/644, 69, 64, 641; 135/102, 103, 106, 110, 113

[56] References Cited

U.S. PATENT DOCUMENTS

| | | | |
|---|---|---|---|
| 4,373,305 | 2/1983 | Russell | 52/645 X |
| 4,782,641 | 11/1988 | Manenti et al. | 52/639 |
| 4,945,936 | 8/1990 | Surrendi | 135/98 |

FOREIGN PATENT DOCUMENTS

| | | | |
|---|---|---|---|
| 1085571 | 9/1980 | Canada | 52/639 |
| 645718 | 9/1962 | Italy | 135/130 |
| 539356 | 9/1941 | United Kingdom | 52/639 |

*Primary Examiner*—Carl D. Friedman
*Assistant Examiner*—Creighton Smith

[57] ABSTRACT

This invention provides an arcuate frame rib for the frame of a covered shelter. The arcuate rib includes an adjustable and pivotal base mounting at each end of the arc. The rib is formed by sections of tubing joined by a rigid coupler having an angled upper member with tube receivers at both ends to slideably receive the tubular sections, a lower member with tube guides at both ends to slideably receive and guide the tubular sections received in the tube receivers and a central body member joining the upper and lower members. The lower member generally includes a reinforcement that carries a double assembly pin receiving tab. Rib braces generally connect the lower members of successive rigid couplers to support the rib by being pinned to the double pin receiving tabs. For further reinforcement, there are generally knee braces formed of knee tubing strengthened by a gussett plate and clamped to the rib braces.

14 Claims, 3 Drawing Sheets

RIB FOR COVERED SHELTER FRAME

This application relates to covered shelters and more particularly to ribs for the frame of a covered shelter.

BACKGROUND OF INVENTION

The need for shelters at low cost that can be easily provided in a variety of locations for varying periods of time became of the utmost importance as world wide development took place at an ever increasing rate.

Many of the present shelters require heavy steel frame structures with a steel cover which requires a great deal of time and equipment such as cranes to assemble which of course can also be dangerous. With the need for something less costly and more versatile new structures and methods have been put forth as shown in applicants copending U.S. application Ser. No. 07/974,069, U.S. Pat. No. 3,361,144 to Folkes and Canadian published application 2,019,415 to Surrendi. In U.S. Pat. No. "144" there is shown a collapsible weatherproof covered frame shelter with arch shaped transverse ribs carrying a pair of grooved rollers to be mounted on a base. The disclosed arch shape is truss braced but does not teach applicants easily assembled sectional frame rib which can be easily reinforced and double reinforced depending on the load to be applied. In Canadian application "415" there is shown a sectioned arch shaped frame to carry a cover to make a shelter. The frame is of a pivotally joined nature and does not teach applicants rigid coupler for slideably receiving sections of tubing to form an arch shaped rib. What applicant is here providing is a sectional tubular frame rib joined together by a special coupler and reinforced as required.

SUMMARY OF THE INVENTION

It is desirable in storing articles or equipment to have the storage facility easily erected, movable to various locations with no lost time and at a price that is acceptable under the circumstances. To achieve these results there is provided an arcuate frame rib for the frame of such a shelter. The arcuate rib includes adjustable and pivotal base mounting means, the rib is formed of sectional tubing forming sections joined by rigid coupler means. The rigid coupler means each have an upper member carrying two sectional tube receivers to slideably receive the sectional tubing, a lower member carrying two sectional tube guides to slideably receive and guide the sectional tubing and a central body member integrally joining the upper member and lower member. The lower member includes a reinforcement that carries a double assembly pin receiving tab to connect rib braces to successive rigid coupler means, the rib braces have clamped thereto knee braces when the expected external load dictates such a requirement.

From the above summary it is readily discernible that the principal object of the present invention is to provide a rib for the frame of a covered shelter that is simple, rugged and easy to assemble.

It is a further object of the present invention to provide a special rib coupler for ease of rib assembly.

It is a further object of the present invention to provide rib which has rib braces and knee braces added thereto to accomodate all types of loads.

It is yet a further object of the present invention to provide the rib with a vertically adjustable pivotal mounting for tightening the shelter cover when applied to the ribs of the frame.

These and other objects of the present invention will become readily apparent as the following description is read in conjunction with the accompanying drawings wherein like reference numerals indicate like elements throughout the several views.

DETAILED DESCRIPTION OF INVENTION

Figure 1:
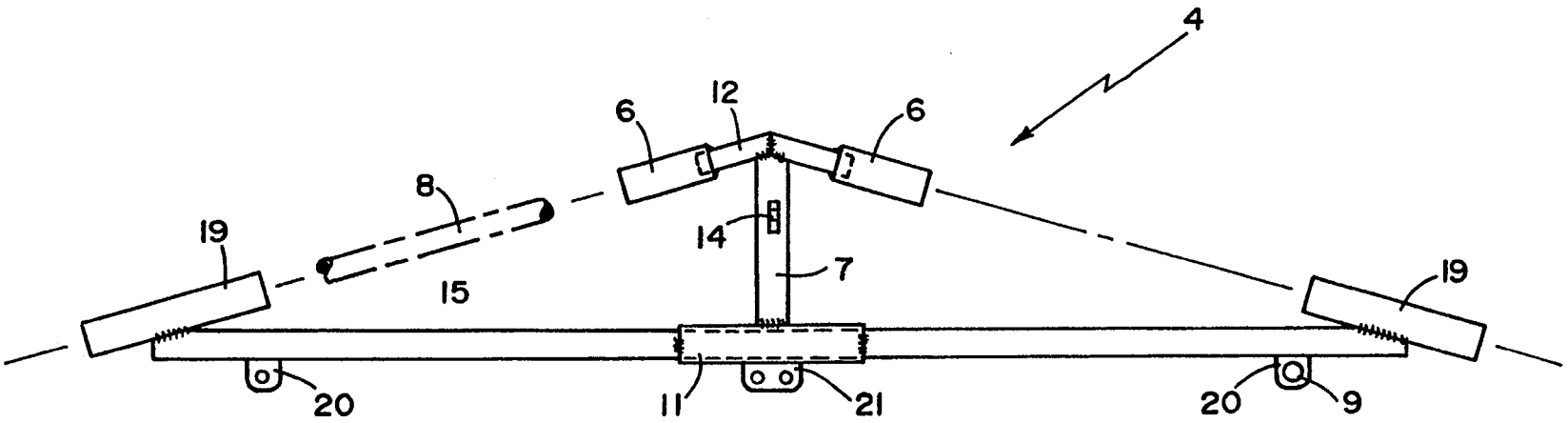
FIG. 1 is a front elevation of the rigid coupler joining means.

Referring now to FIG. 1 there is shown a rigid coupler means 4 for joining together sections of tubing 8 to form the sectionalized rib of a frame to be covered as a shelter. The rigid coupler means 4 is partially formed by providing an angled elongate upper member 12. The elongate upper member 12 carries on each of its ends a female sectional tube receiver 6 to receive a sectional tube 8. The rigid coupler means 4 is partially formed by providing an elongate lower member 15. The elongate lower member 15 carries on each of its ends a sectional tube support and guide 19 to slideably receive and support and guide a sectional tube 8. Integrally joining the elongate upper member 12 and the elongate lower member 15 is an elongate central body member 7 which carries one or more pin receiver tabs 14 at various angles. The central portion of the elongate lower member 15 generally includes a reinforcement 11 which carries a double pin receiver tab 21. Towards the ends of the elongate lower member 15 are pin receiver tabs 20. All the pin receiver tabs are for receiving assembly pins 9 for fast easy assembly of the complete rib and frame.

Figure 2:
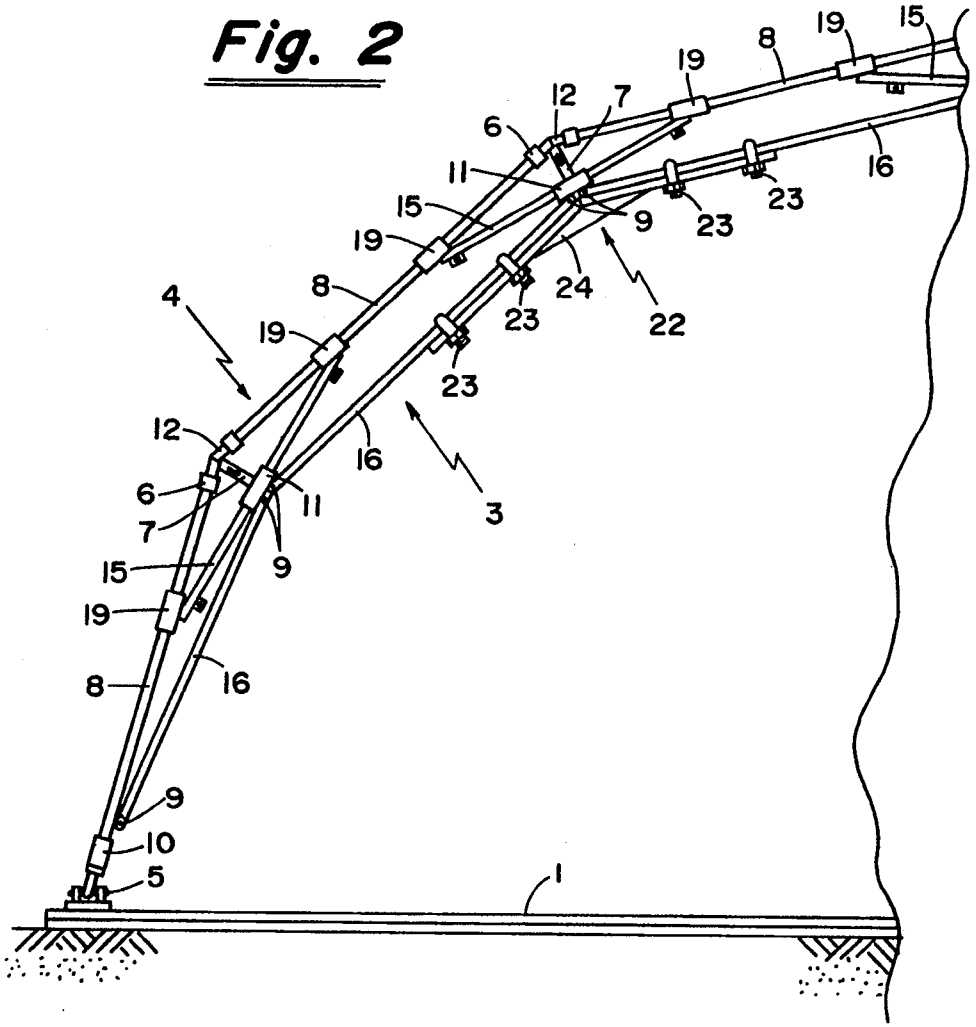
FIG. 2 is a partial front elevation of a fully reinforced rib of the rib frame of a covered shelter.

Now referring to FIG. 2 there is shown basically one half of a reinforced frame rib 3 mounted on a base 1. The frame rib 3 is mounted on base 1 by means of a rib pivot support 5. The rib pivot support 5 which includes a rib pivot support adjuster 10 slideably receives a sectional tube 8 and can adjust it vertically to tighten the cover (not shown) which is placed over the frame ribs of the total frame to make a shelter. Several sectional tubes 8 are joined together to make the frame rib 3 when in the horizontal position and then several of the frame ribs 3 are joined and pivoted to a vertical position to make a complete frame for the shelter. The sectional tubes 8 are joined by rigid coupler means 4 to make an arcuate shape spanning from a rib pivot support on one side of the base 1 to an opposite side of base 1. The rigid coupler means 4 includes an elongate upper member 12 with female sectional tube receivers 6 mounted on both ends to slideably receive sectional tubing 8, an elongate lower member 15 with sectional tube guides 19 on both ends to slideably receive and guide sectional tubing 8, and an elongate central body member 7 joining the elongate upper member 12 and the elongate lower member 15. The elongate lower member 15 is reinforced by a lower member reinforcement 11 which is generally welded thereto and which carries a double pin receiver tab 22. Rib braces 16 are pin connected to the double pin receiver tabs 21 by assembly pins 9 to strengthen the frame rib 3. Should further strength be required due to anticipated loading a knee brace 22 (see FIG. 7) is centrally located beneath the double pin receiver tab 21 and clamped by "U" bolt clamps 23 to rib braces 16.

Figure 3:
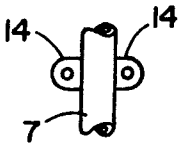
FIG. 3 is an enlarged partial elevation of the central body member of a rigid coupler with fore and aft pin receiving tabs.

FIG. 3 is shown to indicate how the pin receiving tabs 14 may be mounted fore and aft of the elongate central body member 7.

Figure 4:
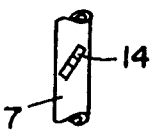
FIG. 4 is a partial elevation of the central body member of a rigid coupler with a 30° offset pin receiving tab.
Figure 6:
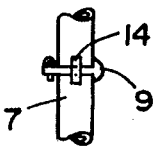
FIG. 6 is a partial elevation of the central body member of a rigid coupler with a 0° offset pin receiving tab.
Figure 5:
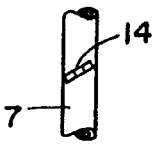
FIG. 5 is a partial elevation of the central body member of a rigid coupler with a 60° offset pin receiving tab.

FIGS. 4, 5 and 6 indicate how the pin receiving tabs 14 may be mounted on the elongate central body member 7 and other members such as on the elongate lower body member 15 and sectional tubing 8. These figures show that the pin receiving tabs 14 may be mounted at various angles and that they may receive an assembly pin 9to make a pivotal connection.

Figure 7:
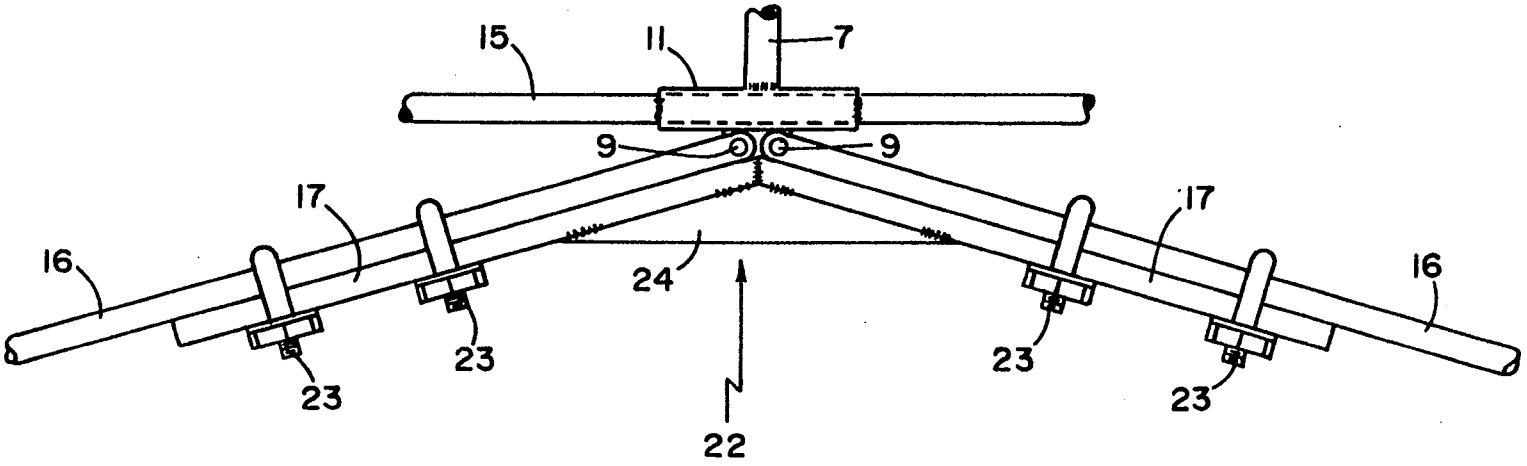
FIG. 7 is a front elevation of a knee brace as applied at the junction of the rib braces connected to the rigid coupler.

Now referring to FIG. 7 there is shown a knee brace 22 used to further reinforce the frame rib 3 from the underside as shown in FIG. 2. The knee brace 22 has sections of knee tubing 17 welded or otherwise unite to form an angle. Centrally located and partially filling in this angle is a gussett plate 24 which is fixed, normally by welding, to the two sections of knee tubing 17. Each section of knee tubing is clamped to a rib brace 16 by "U" bolt clamps 23. Only one knee brace 22 has been shown in FIG. 2 however, they may be placed below two or more of the rigid coupler means 4 as required for loading.

It is to be noted that generally when the rigid coupler means 4 is made of aluminum no assembly pin receiving tabs such as 14, 20 and 21 are included.

Various modifications such as size, shape and arrangement of components may be made without departing from the spirit and scope of the invention. The above disclosure shall be interpreted as illustrative only and limited only by the scope of the invention as defined in the following claims.

What I claim is:

1. A frame rib for the frame of a covered shelter comprising in combination, a first rib pivot support to be mounted on a base, said first rib pivot support including adjusting means, a second rib pivot support to be mounted on said base, said second rib pivot support including adjusting means, a series of sectional tubes joined to form an arc having two ends, each of said arc ends slideably received in one of said first and second rib pivot supports, several rigid couplers each one joining a pair of said series of said joined sectional tubes, each said rigid coupler having an upper member, a lower member, and a central body member joining said upper member and said lower member, said upper member having two ends each of which includes a sectional tube receiver for slideably receiving one end of one of said sectional tubes, said lower member having two ends each of which includes a sectional tube guide to slideably receive and guide one of said sectional tubes, each said lower member including a lower member reinforcement having a double pin receiving tab, a rib brace pin connected between each successive ones of said rigid couplers at said double pin receiving tab.

2. A frame rib as claimed in claim 1 further including a series of knee braces clamped to a successive pair of said rib braces, said knee brace including two sections of knee tubing joined at an angle, a gussett plate reinforcing said knee brace at said angle and wherein said clamped knee braces are held by "U" shaped clamps.

3. A rigid coupler for joining sectional tubing of a joined frame rib comprising in combination, an angled elongate upper tubular member having two ends, a first tubular receiver end consisting solely of a tubular pipe integrally and nonreleasably fixed to each of said angled elongate upper tubular member ends to slidably receive said sectional tubing, a body member integrally and nonreleasably fixed to and extending from said angled elongate upper tubular member, a straight lower one piece double ended elongate tubular member integrally and nonreleasably fixed at a right angle to said body member and a second tubular receiver and consisting solely of an open ended tubular pipe integrally and nonreleasably fixed at an angle to each end of said double ended straight lower one piece elongate tubular member for slidably receiving said sectional tubing that would be slidably received in said first tubular receiver end.

4. A rigid coupler as claimed in claim 3 wherein said straight lower one piece double ended elongate tubular member includes a reinforcement on an intermediate portion thereof, and wherein said straight lower one piece ended elongate tubular member includes assembly pin receiving means mounted thereon.

5. A rigid coupler for joining sectional tubing of a joined frame rib comprising in combination, an angled elongate upper tubular member having two ends, first tubular receiver means integrally and nonreleasably fixed to each end of said angled elongate upper tubular member and formed to slidably receive and release said sectional tubing, a body member integrally and nonreleasably fixed to and extending from said angled elongate upper tubular member, a straight lower double ended elongate tubular member integrally and nonreleasably fixed at a right angle to said body member and second tubular receiver means mounted at each end of said straight lower double ended elongate tubular member at an angle and having two open ends to slidably guide and support said sectional tubing.

6. A rigid coupler as claimed in claim 5 wherein said straight lower double ended elongated tubular member includes a reinforcement on an intermediate portion thereof and wherein said straight lower double ended elongate tubular member includes assembly pin receiving means mounted thereon.

7. A rigid frame rib for the frame of a covered shelter comprising, means for pivotally and vertically adjustably supporting said rigid frame on a base at a first and second location, means forming an arcuate sectionally joined structure between said first and second pivotally and vertically adjustable supporting means and wherein each section includes sectional tubing, means for joining each section of said sectionally joined structure comprising, a rigid coupler including an upper member, a central body member and a lower member all integrally joined, means fixed to said upper member and to said lower member to slidably receive said sectional tubing, said means fixed to said lower member being fixed thereto at an angle such as to receive and guide intermediate portions of said tubing received by said fixed means of said upper member thereby forming said arcuate sectionally joined rigid frame rib.

8. A rigid frame rib as claimed in claim 7 wherein said means fixed to said upper member internally slidably receives said sectional tubing and wherein said means fixed to said lower member is an open ended tube.

9. A rigid frame rib as claimed in claim 8 wherein said lower member includes a single elongate member fixed at a right angle to said central body member.

10. A rigid frame rib as claimed in claim 9 wherein said lower member further includes a reinforcement means carrying assembly pin receiving means.

11. A rigid frame rib for the frame of a covered frame shelter comprising in combination, base mounting means including a first base mounting means and a second base mounting means, joined sectional tubing extending from said first base mounting means to said second base mounting means, two or more rigid coupler means joining said joined sectional tubing in such s manner as to form an arcuate surface to receive the cover of said covered frame shelter, each said rigid coupler means including an upper member, a body member and a lower member all integrally joined, said upper member including an angled elongate tube having two ends, first receiver means fixed on each of said two ends of said angled elongate tube for slidably receiving a section of said joined sectional tubing, said lower member including a straight elongate tube fixed to said body member at a right angle and having two ends, second receiver means fixed on each of said two ends of said straight elongate tube at an angle for slidably receiving said section of said joined sectional tubing, each said rigid coupler means are joined by a section of said joined sectional tubing received in said first receiver means of each successive rigid coupler means.

12. A rigid frame rib as claimed in claim 11 wherein each said lower member further includes assembly pin receiving means mounted thereon and wherein rib braces are connected by assembly pins received in said assembly pin receiving means to at least two of said two or more rigid coupler means.

13. A rigid frame rib as claimed in claim 12 further including a knee brace supporting adjacent pairs of said rib braces.

14. A rigid frame rib as claimed in claim 13 wherein said knee brace includes joined knee tubing forming an angle, a gussett plate fixed in said angle and "U" bolt clamps clamping said knee brace to adjacent ones of said rib braces.

* * * * *